US011333153B2

(12) United States Patent
Omori et al.

(10) Patent No.: US 11,333,153 B2
(45) Date of Patent: May 17, 2022

(54) VACUUM PUMP AND CONTROL APPARATUS ASSOCIATED WITH VACUUM PUMP

(71) Applicant: Edwards Japan Limited, Yachiyo (JP)

(72) Inventors: Hideki Omori, Yachiyo (JP); Yanbin Sun, Yachiyo (JP); Kengo Saegusa, Yachiyo (JP); Yoshiyuki Sakaguchi, Yachiyo (JP)

(73) Assignee: Edwards Japan Limited, Yachiyo (JP)

( * ) Notice: Subject to any disclaimer, the term of this patent is extended or adjusted under 35 U.S.C. 154(b) by 85 days.

(21) Appl. No.: 16/467,416

(22) PCT Filed: Dec. 8, 2017

(86) PCT No.: PCT/JP2017/044245
§ 371 (c)(1),
(2) Date: Jun. 6, 2019

(87) PCT Pub. No.: WO2018/110466
PCT Pub. Date: Jun. 21, 2018

(65) Prior Publication Data

US 2019/0309760 A1 Oct. 10, 2019

(30) Foreign Application Priority Data

Dec. 16, 2016 (JP) ..... JP2016-244436

(51) Int. Cl.
*F04D 19/04* (2006.01)
*F04D 25/06* (2006.01)
*F04B 37/14* (2006.01)

(52) U.S. Cl.
CPC ..... *F04D 19/042* (2013.01); *F04B 37/14* (2013.01); *F04D 19/04* (2013.01); *F04D 25/068* (2013.01)

(58) Field of Classification Search
CPC .. F04D 19/042; F04D 25/0693; F04D 25/068; F04D 27/00; F04D 27/0292;
(Continued)

(56) References Cited

U.S. PATENT DOCUMENTS

2010/0247350 A1 9/2010 Nagano et al.
2013/0189089 A1 7/2013 Schroder et al.
2013/0209272 A1* 8/2013 Omori ..... F04D 29/5813 417/26

FOREIGN PATENT DOCUMENTS

EP 1898098 A2 3/2008
EP 2626568 A1 8/2013
(Continued)

OTHER PUBLICATIONS

Translation and original International Search Report and Written Opinion dated Feb. 20, 2018 in counterpart International Application No. PCT/JP2017/044245, 9 pp.
(Continued)

*Primary Examiner* — Kenneth J Hansen

(57) ABSTRACT

A vacuum pump includes a regenerative resistor removed from the control apparatus and disposed in the vacuum pump. More specifically, the regenerative resistor is detached from a control board (control apparatus) on which a control circuit is mounted, and disposed in a base of the vacuum pump, and connected to the control board via a wire. Further, a gap is provided between the base of the vacuum pump and the control apparatus. Moreover, a cover (outer covering body) is provided in the regenerative resistor disposed in the base part of the vacuum pump and the wire part. Since the regenerative resistor is provided in the base of the vacuum pump, which has a large heat capacity, a temperature increase of the control apparatus is reduced.

18 Claims, 4 Drawing Sheets

(58) Field of Classification Search
CPC ... F04B 37/14; H02P 3/14; H02P 3/22; H01R 13/533
See application file for complete search history.

(56) References Cited

FOREIGN PATENT DOCUMENTS

| | | | |
|---|---|---|---|
| FR | 2747431 | A1 | 10/1997 |
| JP | WO2008062598 | A1 | 3/2010 |
| JP | 2010236468 | A | 10/2010 |
| JP | 2012017672 | A | 1/2012 |
| JP | 2013119798 | A | 6/2013 |
| WO | 2012/046495 | A1 | 4/2012 |

OTHER PUBLICATIONS

Extended Search Report from counterpart European Application No. 17880309.4, dated Jun. 30, 2020, 8 pp.

* cited by examiner

VACUUM PUMP AND CONTROL APPARATUS ASSOCIATED WITH VACUUM PUMP

This application is a U.S. national phase application under 37 U.S.C. § 371 of international application number PCT/JP2017/044245 filed on Dec. 8, 2017, which claims the benefit of priority to JP application number 2016-244436 filed Dec. 16, 2016. The entire contents of each of international application number PCT/JP2017/044245 and JP application number 2016-244436 are incorporated herein by reference.

TECHNICAL FIELD

The present disclosure relates to a vacuum pump and a control apparatus associated with the vacuum pump.

More specifically, the present disclosure relates to a vacuum pump provided with a control apparatus having a regenerative resistor, and a control apparatus associated with the vacuum pump.

BACKGROUND

A vacuum pump such as a turbomolecular pump that exhausts by rotating a rotor thereof at high speeds in a casing having an inlet port and an outlet port typically has a control apparatus (controller) connected electrically thereto, the control apparatus controlling a motor for rotating the rotor.

In a rotary machine using such a motor, rotation of the motor at deceleration of the rotary machine produces electric energy (regenerative energy). This regenerative energy triggers an increase in DC voltage in a motor driver circuit controlling the motor, which may lead to a malfunction of in-circuit elements. For this reason, the regenerative energy needs to be treated/consumed properly.

A regenerative resistor can be named as one of the methods for treating the regenerative energy.

The regenerative resistor is a resistor that converts the regenerative energy into thermal energy and consumes the resultant thermal energy. Because short wires have conventionally been used as such regenerative resistors, as described in Japanese Patent Application Publication No. H07-279962, Japanese Patent Application Publication No. 2002-180990, and Japanese Patent Application Publication No. 2004-112877, the regenerative resistor is installed in the control apparatus.

SUMMARY

However, with the regenerative resistor being installed in the control apparatus, the heat of the regenerative resistor easily becomes locked up in the control apparatus and therefore cannot easily be dissipated. Even if the heat is dissipated, a temperature rise of the control apparatus is drastic due to a small heat capacity of the control apparatus. Since the generation of heat of the regenerative resistor is inevitable, from the standpoint of safety and reliability, the regenerative resistor itself needs to be constantly cooled in order to keep the temperature of the control apparatus significantly lower than the tolerance of the regenerative resistor.

Examples of the method for cooling the regenerative resistor include preparing a heatsink (radiator, radiator plate) separately and attaching the heatsink in the vicinity of the control apparatus installed with the regenerative resistor generating heat, to dissipate the heat of the regenerative resistor and to thereby reduce the temperature of the control apparatus.

Alternatively, another method is to attach an air-cooling fan (cooling fan) or the like to the control apparatus to enhance the coolability by forcibly increasing the airflow.

Yet another method is to connect a water-cooled plate to the control apparatus, the water-cooled plate having a water-cooling pipe embedded circumferentially, and let a coolant flow into the cooling pipe so that the water-cooled plate is cooled, thereby forcibly cooling the control apparatus in contact with the cooling plate and the regenerative resistor installed in the control apparatus.

However, in a vacuum pump, it is difficult to separately provide the heatsink because the size of the vacuum pump is usually small in relation to the power of the motor and the environment around the vacuum pump needs to be cleaned in connection with the steps of a vacuum device. Moreover, given noise, reliability and the like, in some cases the fan cannot be provided.

Further, when providing the cooling device separately, a special cooling pipe or cooling system is required, which may not only lead to a cost increase but also bring out the need to secure space for disposing such cooling member.

Thus, one of the difficulties in installing the conventional regenerative resistor in a control apparatus is providing a device for cooling the control apparatus. It is also difficult to downsize a vacuum pump in which the control apparatus is to be disposed, to secure space for disposing the cooling member described above.

An object of the present disclosure is to realize a vacuum pump capable of improving the heat dissipation capability of a regenerative resistor with a simple configuration, and a control apparatus associated with such a vacuum pump.

A vacuum pump may include a control apparatus provided with a control board portion equipped with a control circuit for controlling a vacuum pump main body, and a regenerative resistor for treating regenerative energy generated by controlling the vacuum pump main body, wherein the control board portion is disposed inside a control board portion casing which is a casing enclosing the control board portion, and the regenerative resistor is disposed in the vacuum pump main body and connected to the control board portion by a wire.

In some examples, the vacuum pump main body has a housing in which an inlet port and an outlet port are formed, the housing is configured with at least an inlet port-side casing portion and an outlet port-side casing portion, and the regenerative resistor is disposed in the outlet port-side casing portion.

In some examples, the outlet port-side casing portion is controlled to keep a predetermined temperature.

In some examples, the control board portion casing is disposed under the outlet port-side casing portion and integrated with the vacuum pump main body.

In some examples, a predetermined gap for thermal insulation is provided between the outlet port-side casing portion and the control board portion casing.

In some examples, a vacuum pump further includes an outer covering body for covering at least a part of a section of the outlet port-side casing portion in which the regenerative resistor is disposed.

The disclosure also describes a control apparatus associated with a vacuum pump as described herein.

According to the present disclosure, the heat dissipation capability of a regenerative resistor can be improved with a simple configuration by removing the regenerative resistor from a control board of a control apparatus and disposing the regenerative resistor in a vacuum pump having a relatively large heat capacity.

According to this configuration, a cooling device for the control apparatus no longer needs to be provided separately, and as a result reduction in size of the control apparatus and the vacuum pump having the control apparatus can be realized.

DETAILED DESCRIPTION

(i) Outline of Embodiment

In the present embodiment, a regenerative resistor (regenerative resistor portion of a control apparatus) is removed from a control board (control board portion) of the control apparatus and disposed in a base of a vacuum pump.

More specifically, the regenerative resistor is detached from a motor drive unit (control apparatus) which is a board on which a control circuit for controlling the vacuum pump is mounted. The detached regenerative resistor is then disposed in the base of the vacuum pump through a wire, the vacuum pump having a large heat capacity.

Furthermore, a gap is provided between the vacuum pump (base part) and the control apparatus to prevent transmission of heat generated in the regenerative resistor to the control apparatus.

In addition, in order to reduce/attenuate an electrical noise that is generated by separately placing the regenerative resistor on the base, a cover (an outer covering body) is provided on the regenerative resistor disposed in the base part of the vacuum pump and at least a part of the wire portion.

According to this configuration, in the present embodiment, the regenerative resistor is separated from the control apparatus (the regenerative resistor is connected by the wire) and provided in the vacuum pump having a large heat capacity (the base part, in the present embodiment). Therefore, a temperature increase of the control apparatus itself can be reduced/attenuated.

By providing a gap between the base part (i.e., an outlet port-side casing portion) of the vacuum pump where the regenerative resistor is provided and the control apparatus (i.e., a control board portion casing), air for heat insulation fills the gap. As a result, not only is it possible to realize heat insulation by the air, but also a temperature increase of the control apparatus can be reduced/attenuated.

By providing a cover (outer covering body/harness) in the base part where the regenerative resistor is disposed, an electrical noise generated by stretching the wire for separately placing the regenerative resistor can be reduced/attenuated.

(ii) Details of Embodiment

A preferred embodiment of the present disclosure is described hereinafter in detail with reference to FIGS. 1 to 4.

Configuration of Vacuum Pump 1

Figure 1:
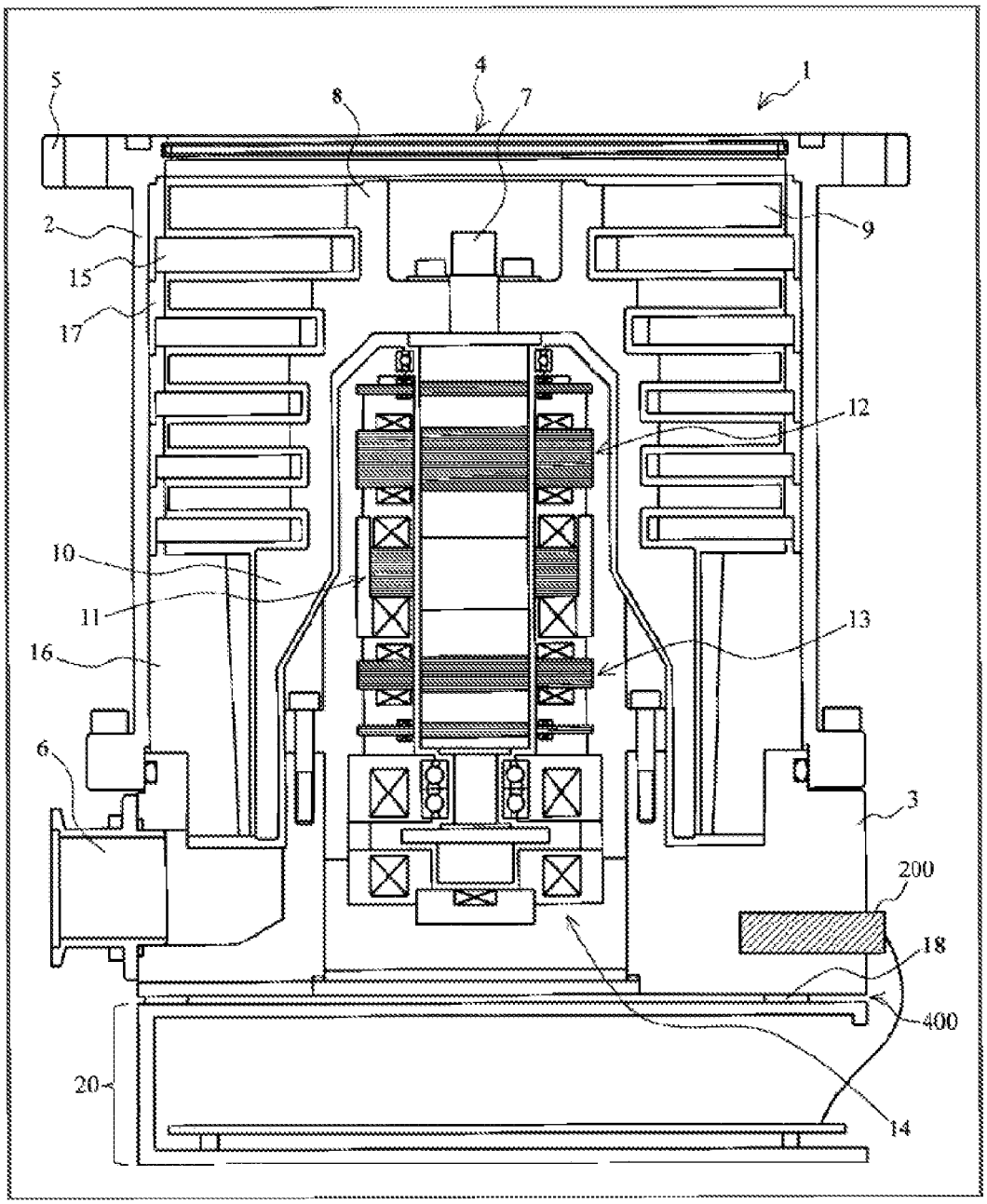
FIG. 1 is a diagram showing an example of a schematic configuration of a vacuum pump according to an embodiment of the present disclosure.

FIG. 1 is a diagram showing an example of a schematic configuration of a vacuum pump 1 according to an embodiment of the present disclosure, the diagram showing a cross section of the vacuum pump 1 along an axial direction.

The vacuum pump 1 according to the present embodiment is configured by a vacuum pump main body, and a control apparatus (control unit) 20 controlling the vacuum pump main body and including a regenerative resistor 200.

In the present embodiment, the control apparatus 20 for controlling the vacuum pump main body is attached to the vacuum pump main body via a pump fixing spacer 18. In other words, the vacuum pump main body and the control apparatus 20 are integrated, with a gap 400 therebetween. In the following description of the present embodiment (the configuration of the vacuum pump 1), "vacuum pump 1" indicates the vacuum pump main body unless otherwise specified.

First, the vacuum pump 1 according to the present embodiment is explained.

The vacuum pump 1 of the present embodiment is a so-called compound molecular pump having a turbomolecular pump portion and a thread groove pump portion.

A casing 2 (inlet port-side casing portion) configuring a housing of the vacuum pump 1 has a substantially cylindrical shape and constitutes a case of the vacuum pump 1 together with a base 3 (outlet port-side casing portion) provided in a lower portion of the casing 2 (outlet port 6 side). A gas transfer mechanism, which is a structure bringing about an exhaust function of the vacuum pump main body, is stored in the case of the vacuum pump 1.

This gas transfer mechanism is composed mainly of a rotating portion supported rotatably and a stator portion fixed to the case of the vacuum pump 1.

An inlet port 4 for introducing gas into the vacuum pump 1 is formed at an end portion of the casing 2. A flange portion 5 protruding toward an outer periphery of the casing 2 is formed on an end surface of the casing 2 at the inlet port 4 side.

The outlet port 6 for exhausting the gas from the vacuum pump 1 is formed in the base 3.

Although not shown, a cooling (water-cooling) pipe composed of a tube (pipe)-like member is embedded in the base 3 for the purpose of reducing the impact of heat that the control apparatus 20 receives from the vacuum pump 1. Thus, the temperature of the base 3 is controlled. This cooling pipe is a member configured to cool the periphery thereof by allowing a coolant, which is a heat medium, to flow therein and causing this coolant to absorb the heat.

Since the base 3 is forced to cool down by letting the coolant flow into the cooling pipe as described above, the heat conducted from the vacuum pump 1 to the control apparatus 20 is reduced (attenuated).

Note that a member with low thermal resistance, i.e., a member with high thermal conductivity, such as copper or stainless steel, is used as a material of the cooling pipe. The coolant flowing through the cooling pipe, that is, a material for cooling an object, may be in the form of liquid or gas.

Water, a calcium chloride aqueous solution, an ethylene glycol aqueous solution or the like, for example, can be used as the coolant if the coolant is a liquid. On the other hand, if the coolant is a gas, ammonia, methane, ethane, halogen, helium, carbon dioxide, air or the like, for example, can be used.

The rotating portion includes a shaft 7 which is a rotating shaft, a rotor 8 disposed on the shaft 7, rotor blades 9 provided on the rotor 8, and a stator column 10 provided on the outlet port 6 side (thread groove pump portion). Note that the shaft 7 and the rotor 8 constitute a rotor portion.

The rotor blades 9 are formed of blades extending radially from the shaft 7 at a predetermined angle from a plane perpendicular to an axis of the shaft 7.

The stator column 10 is formed of a cylindrical member having a cylindrical shape which is concentric with a rotation axis of the rotor 8.

A motor portion 11 for rotating the shaft 7 at high speeds is provided in the middle of the shaft 7 in the axial direction thereof.

Radial magnetic bearing devices 12, 13 for supporting the shaft 7 in a radial direction in a non-contact manner are provided on the inlet port 4 side and the outlet port 6 side respectively, with respect to the motor portion 11 of the shaft 7, and axial magnetic bearing devices 14 for supporting the shaft 7 in the axial direction in a non-contact manner are provided at a lower end of the shaft 7.

A stator portion is formed on an inner periphery side of the case of the vacuum pump 1. The stator portion is composed of stator blades 15 provided on the inlet port 4 side (turbomolecular pump portion), a thread groove spacer 16 provided on an inner peripheral surface of the casing 2, and the like.

The stator blades 15 are formed of blades extending from an inner peripheral surface of the case of the vacuum pump 1 toward the shaft 7, at a predetermined angle from a plane perpendicular to the axis of the shaft 7.

The stator blades 15 in respective stages are separated by cylindrical spacers 17.

In the vacuum pump 1, the stator blades 15 are formed in a plurality of stages alternately with the rotor blades 9 along the axial direction.

Spiral grooves are formed on a surface of the thread groove spacer 16 that faces the stator column 10. The thread groove spacer 16 faces an outer peripheral surface of the stator column 10, with a predetermined clearance (space) therebetween. The direction of the spiral grooves formed in the thread groove spacer 16 is the direction toward the outlet port 6 when a gas is transported through the spiral grooves in the direction of rotation of the rotor 8.

The depth of the spiral grooves is adapted to become shallower toward the outlet port 6, and therefore the gas transported through the spiral grooves is configured to be compressed as the gas approaches the outlet port 6.

The vacuum pump 1 configured as described above performs vacuum exhaust processing in a vacuum chamber (not shown) disposed in the vacuum pump 1. The vacuum chamber is a vacuum device used as, for example, a chamber or the like of a surface analyzer or a microfabrication apparatus.

Control apparatus 20 of Vacuum Pump 1

A structure of the control apparatus 20 attached to the vacuum pump 1 having the foregoing configuration is described next.

Figure 2:
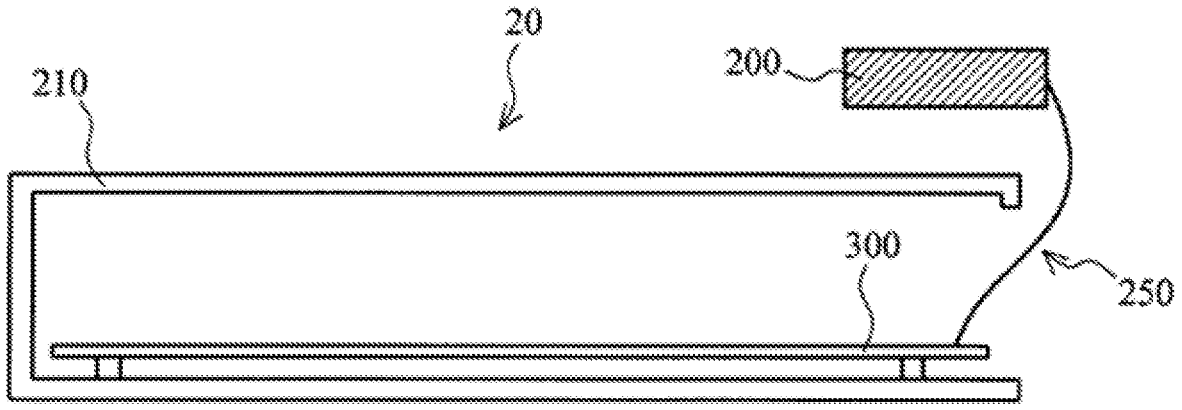
FIG. 2 is a diagram showing an example of a schematic configuration of a control apparatus having a regenerative resistor according to the embodiment of the present disclosure.

FIG. 2 is a diagram showing an example of a schematic configuration of the control apparatus 20 according to the present embodiment.

The control apparatus 20 according to the present embodiment is a control unit having a control circuit for controlling various operations performed in the vacuum pump 1, and is disposed in (attached to) a bottom portion of the base 3 of the vacuum pump 1 via the pump fixing spacer 18, as shown in FIG. 1.

The control apparatus 20 of the present embodiment is provided with a connector (not shown) paired with a connector provided in the vacuum pump 1 (not shown), and the control circuit provided in the control apparatus 20 is configured to be electrically connected to electronic components of the vacuum pump 1 by joining (coupling) the connector of the vacuum pump 1 and the connector of the control apparatus 20 to each other. Therefore, the control apparatus 20 can supply drive signals and power of the motor portion 11, the radial magnetic bearing devices 12, 13, the axial magnetic bearing devices 14, and a displacement sensor (not shown) of the vacuum pump 1 to the vacuum pump 1 and receive various signals from the vacuum pump 1 without using a dedicated cable for connecting the vacuum pump 1 and the control apparatus 20.

The control apparatus 20 according to the present embodiment includes a case 210, a regenerative resistor 200, a conducting wire 250, and a control board 300.

The case 210 (control board portion casing) is a housing of the control apparatus 20 that is configured by aluminum die casting and has the control board 300 fixed inside the case 210.

The regenerative resistor 200 is a component for treating regenerative energy (electric energy) generated when the vacuum pump 1 decelerates, converts this regenerative energy into thermal energy and consumes the resultant thermal energy.

The present embodiment explains an example in which two equivalent regenerative resistors 200 are disposed (one of them is not shown in FIG. 2). The number of regenerative resistors 200 to be disposed can be set accordingly depending on the costs and the like.

The control board 300 is a board on which the control circuit for controlling the vacuum pump 1 is mounted (motor drive unit), and in the present embodiment a plurality of the control boards 300 are fixed inside the case 210. The control circuit mounted on each of the control boards 300 is provided with drive circuits, power circuits and the like of the motor portion 11, the radial magnetic bearing devices 12, 13, and the axial magnetic bearing devices 14 of the vacuum pump 1. In addition, a circuit for controlling these drive circuits, and a storage element containing various information used in controlling the vacuum pump 1, are mounted on each of the control boards 300.

Environmental temperatures taking reliability into consideration are typically set in electronic components (elements) used in electronic circuits. The storage element described above is a low heat-resistant element having heat-resistant characteristics in which the set environmental temperature is approximately 60° C. Note that, during the operation of the vacuum pump 1, each of the electrical components must be used within a set range of environmental temperatures. Also, in addition to the low heat-resistant element, many components (power devices) that generate heat by loss occurring in the element (internal loss) are used as the circuits provided inside the control apparatus 20. Examples of such components include transistor elements constituting an inverter circuit which is the drive circuit of the motor portion 11. Environmental temperatures are also set for such elements that produce high amounts of self-heat.

The regenerative resistor 200 according to the present embodiment is attached to the control board 300 by the conducting wire 250.

The conducting wire 250 is long enough to reach the base 3 of the vacuum pump 1 disposed in an upper part of the control apparatus 20 and connects the regenerative resistor 200 and the control board 300 to each other.

The regenerative resistor 200 that is at least partially connected to the control board 300 by the conducting wire 250 is separated from the control apparatus 20 itself, embedded in the base 3 of the vacuum pump 1, and fixed to the base 3 using a screw or the like (FIG. 1).

In the present embodiment, the regenerative resistor 200 is separated from the control apparatus 20 without being installed in the control apparatus 20, and installed in (fixed to) the base 3 of the vacuum pump 1.

By disposing the regenerative resistor 200 in the base 3 of the vacuum pump 1 having a relatively large heat capacity, the heat dissipation capability of the regenerative resistor 200 can be improved with a simple configuration.

The regenerative resistor 200 can also be cooled by the cooling device disposed in the vacuum pump 1. Since a cooling device for the control apparatus 20 no longer needs to be provided, reduction in size of the control apparatus 20 and the vacuum pump 1 having the control apparatus 20 can be realized.

The present embodiment has described an example in which the regenerative resistor 200 is provided in the base 3 in which the outlet port is disposed, but the present disclosure is not limited to this configuration. If there exists a section where a housing other than the casing 2 or the base 3 is formed, the regenerative resistor 200 may be disposed in this section.

The present embodiment has described an example in which the control apparatus 20 is disposed at the bottom portion of the base 3 of the vacuum pump 1, but the present disclosure is not limited to this configuration. For example, the control apparatus 20 may be disposed on a side surface of the base 3.

The gap 400 according to the present embodiment is described next with reference to FIG. 1.

In the present embodiment, when separating the regenerative resistor 200 from the control apparatus 20 in the foregoing configuration, the gap 400 is further provided between the vacuum pump 1 (base 3) and the control apparatus 20.

Because the temperature of the base 3 of the vacuum pump 1 in which the regenerative resistor 200 is disposed increases as the regenerative resistor 200 generates heat, the gap 400 is provided between the vacuum pump 1 and the control apparatus 20 to insulate them with air, so that the heat of the regenerative resistor 200 is not transmitted to the control apparatus 20 through the base 3. The gap 400 is desirably approximately 0.1 mm to 10 mm in accordance with the setting of each component.

The gap 400 can be provided by, for example, raising the pump fixing spacer 18 by approximately 2 mm.

The pump fixing spacer 18 is desirably manufactured with a material having poor heat conduction (such as iron). Therefore, conduction of the heat of the regenerative resistor 200 from the base 3 to the control apparatus 20 can be reduced more effectively.

It is preferred that a gap not be provided between the base 3 and the regenerative resistor 200, in order to allow the base 3 to effectively absorb the heat of the regenerative resistor 200. However, since the regenerative resistor 200 expands as it generates heat, the regenerative resistor 200 is preferably configured to be held (stored) in the base 3 with no gap therebetween (so as to stick to the base 3 tightly), in view of the expansion width of the regenerative resistor 200.

In the present embodiment, the pump fixing spacer 18 is provided between the base 3 of the vacuum pump 1 provided with the regenerative resistor 200 separated from the control apparatus 20, and the control apparatus 20.

According to this configuration, by providing the gap 400 between the vacuum pump 1 (base 3) and the control apparatus 20, insulation using air can be realized, further improving the heat dissipation capability of the regenerative resistor 200.

With the gap 400 provided therebetween, the weight of the vacuum pump 1 imposed on the control apparatus 20 can be released, whereby the load on the control apparatus 20 caused by the weight of the vacuum pump 1 can be reduced.

Figure 3:
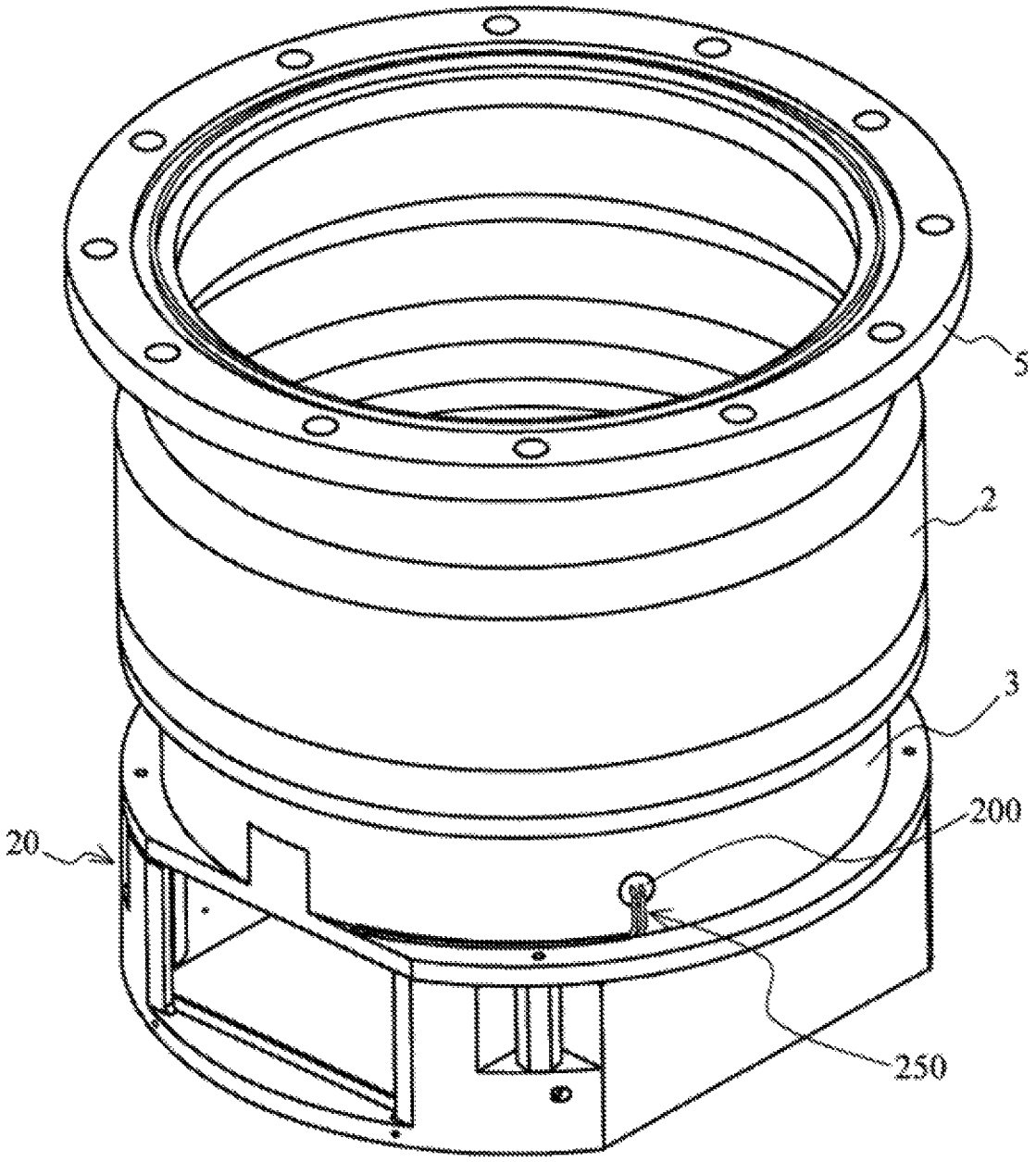
FIG. 3 is a diagram showing an example of arranging the vacuum pump and the control apparatus (regenerative resistor) according to the embodiment of the present disclosure.

FIG. 3 is a diagram showing an example of a configuration in which the regenerative resistor 200 (control apparatus 20) according to the present embodiment is disposed on the base 3.

In the present embodiment, in order to insert (store) the regenerative resistor 200 in the base 3, a hollow portion capable of storing the regenerative resistor 200 is provided in an outer portion of the base 3, and the regenerative resistor 200 is inserted into this hollow portion and secured thereto with a screw.

In the present embodiment, because the regenerative resistor 200 and the base 3 are in close contact with each other, the regenerative resistor 200 can also be cooled by a cooling device (not shown) for cooling the base 3.

The outer covering body (cover) disposed in the part where the regenerative resistor 200 is disposed is described next.

Figure 4:
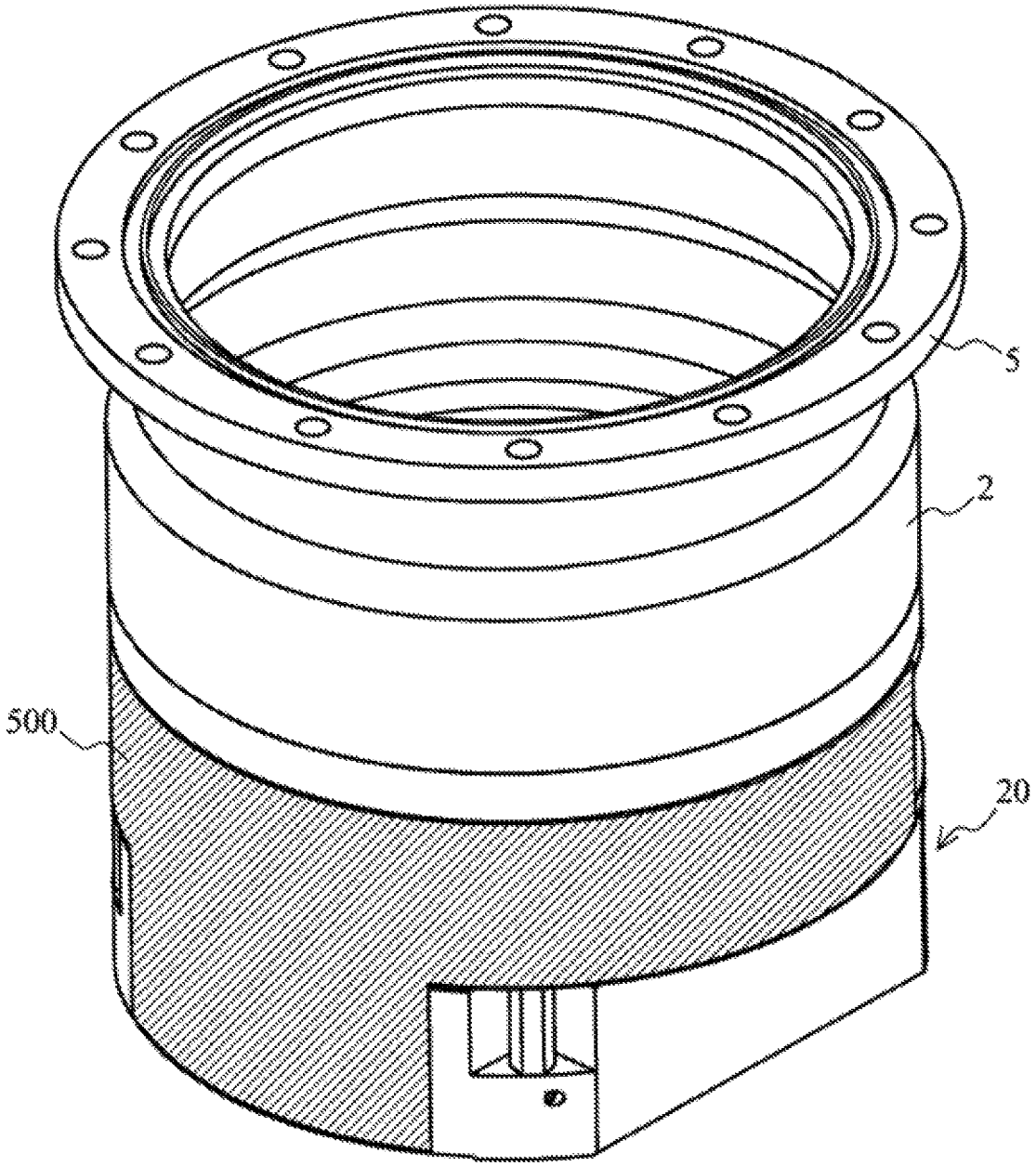
FIG. 4 is a diagram showing an example of a configuration in which an outer covering body is disposed when arranging the vacuum pump and the control apparatus (regenerative resistor) according to the embodiment of the present disclosure.

FIG. 4 is a diagram showing an example of a configuration in which the part where the regenerative resistor 200 of the present embodiment is disposed is covered with a cover 500.

As shown in FIG. 4, in the present embodiment, the part of the base 3 where the regenerative resistor 200 is disposed is covered with the cover 500.

Such a configuration can cut off electrical noises that can be generated due to long wiring when the regenerative resistor 200 is disposed outside the control apparatus 20 (control board 300). Such a configuration can also insulate a charged portion that is exposed by separately placing the regenerative resistor 200.

Furthermore, separately placing (storing) the regenerative resistor 200 can lead to lowering of an indirect surface temperature of the base 3 which can become high. As a result, for example, the safety for a worker who performs inspection and touches the base 3 can be improved.

The present embodiment has the configuration in which the entire part where the regenerative resistor 200 is disposed is covered with the cover 500, but the present disclosure is not limited to this configuration. The shape and size of the cover 500 can be changed accordingly as long as at least the regenerative resistor 200 and the conducting wire 250 (the part connecting the regenerative resistor 200 and the control board 300) are covered.

Note that the cover 500 is desirably made of a material having poor heat conduction such as stainless steel (SUS).

In the present embodiment, even when the cover 500 is provided on the base 3, a gap of approximately 1 mm (gap 400) is provided between the control apparatus 20 and the base 3.

According to the configurations described above, the present embodiment can achieve the following effects.

(1) By treating the heat emitted from the regenerative resistor 200 by means of the base 3 having a large heat capacity, a temperature increase of the control apparatus 20 can be reduced (attenuated).

Specifically, not only is it possible to improve the heat dissipation capability of the regenerative resistor 200 with a simple configuration, but also the control apparatus 20 capable of appropriately reducing/attenuating a temperature increase thereof and the vacuum pump 1 having the control apparatus 20 can be provided.

(2) By installing the control apparatus 20 and the base 3 at positions separated by a predetermined clearance (gap 400), a temperature increase of the control apparatus 20 and the heavy load of the vacuum pump 1 can be reduced.

(3) Due to the configuration in which the cover 500 is provided, the following issues (a) and (b) that can be caused by separately placing the regenerative resistor 200 can be reduced.

(a) Electrical noises that can be generated due to long wiring can be cut off.

(b) Disposing the regenerative resistor 200 can lead to lowering of an indirect surface temperature of the base 3 which can become high.

In the present embodiment, although the regenerative resistor 200 is disposed on the base 3 of the vacuum pump 1 from the perspective of being a temperature-controlled component, the place where the regenerative resistor 200 is placed separately is not necessarily limited to the base 3 of the vacuum pump 1. Depending on the specification of the vacuum pump 1 or the situation in which the vacuum pump 1 is disposed, the regenerative resistor 200 may be disposed in any other component of the vacuum pump 1 as long as the component has a large heat capacity.

Although, in the present embodiment, the gap 400 is provided between the base 3 of the vacuum pump 1 on which the regenerative resistor 200 is provided and the control apparatus 20, the present disclosure is not limited to this configuration. For example, a heat insulating material may be provided together with or in place of the gap 400.

Note that various shapes and sizes can be adopted for the regenerative resistor 200.

In order to cope with the differences between such shapes and sizes and non-smoothness of the surface, instead of inserting the regenerative resistor 200 directly into the base 3 of the vacuum pump 1, the regenerative resistor 200 may be placed in a metal case specially made for a regenerative resistor, and then this metal case may be inserted (stored) into a regenerative resistor casing (hollow portion). In this case, the metal case is desirably made of heat-resistant steel or stainless steel (SUS).

Note that the embodiment of the present disclosure and each modification thereof may be combined as needed.

Various modifications can be made to the present disclosure without departing from the spirit of the present disclosure, and it goes without saying that the present disclosure extends to such modifications.

REFERENCE SIGNS LIST

1 Vacuum pump
2 Casing
3 Base
4 Inlet port
5 Flange portion
6 Outlet port
7 Shaft
8 Rotor
9 Rotor blade
10 Stator column
11 Motor portion
12, 13 Radial magnetic bearing device
14 Axial magnetic bearing device
15 Stator blade
16 Thread groove spacer
17 Spacer
18 Pump fixing spacer
20 Control apparatus (control unit)
200 Regenerative resistor
210 Case
250 Conducting wire
300 Control board
400 Gap
500 Cover

What is claimed is:

1. A vacuum pump, comprising:

a vacuum pump main body comprising a housing in which an inlet port and an outlet port are formed;

a control apparatus provided with a control board portion equipped with a control circuit for controlling operations performed in the vacuum pump main body;

a regenerative resistor for treating regenerative energy generated by controlling the operations performed in the vacuum pump main body; and a hollow portion having an opening portion on an outer peripheral surface of the housing of the vacuum pump main body, wherein the control board portion is disposed inside a control board portion casing, which encloses the control board portion, and the regenerative resistor is inserted into the hollow portion, disposed in the vacuum pump main body and connected to the control board portion by a wire.

2. The vacuum pump according to claim 1, wherein the housing is configured with at least an inlet port-side casing portion and an outlet port-side casing portion, and the regenerative resistor is disposed in the outlet port-side casing portion.

3. The vacuum pump according to claim 2, wherein the outlet port-side casing portion is controlled to keep a predetermined temperature.

4. The vacuum pump according to claim 3, wherein the control board portion casing is disposed under the outlet port-side casing portion and integrated with the vacuum pump main body.

5. The vacuum pump according to claim 4, wherein a predetermined gap for thermal insulation is provided between the outlet port-side casing portion and the control board portion casing.

6. The vacuum pump according to claim 5, further comprising an outer covering body for covering at least a part of a section of the outlet port-side casing portion in which the hollow portion housing the regenerative resistor is disposed.

7. The vacuum pump according to claim 4, further comprising an outer covering body for covering at least a part of a section of the outlet port-side casing portion in which the hollow portion housing the regenerative resistor is disposed.

8. The vacuum pump according to claim 3, wherein a predetermined gap for thermal insulation is provided between the outlet port-side casing portion and the control board portion casing.

9. The vacuum pump according to claim 3, further comprising an outer covering body for covering at least a part of a section of the outlet port-side casing portion in which the hollow portion housing the regenerative resistor is disposed.

10. The vacuum pump according to claim 2, wherein the control board portion casing is disposed under the outlet port-side casing portion and integrated with the vacuum pump main body.

11. The vacuum pump according to claim 2, wherein a predetermined gap for thermal insulation is provided between the outlet port-side casing portion and the control board portion casing.

12. The vacuum pump according to claim 11, further comprising an outer covering body for covering at least a part of a section of the outlet port-side casing portion in which the hollow portion housing the regenerative resistor is disposed.

13. The vacuum pump according to claim 2, further comprising an outer covering body for covering at least a part of a section of the outlet port-side casing portion in which the hollow portion housing the regenerative resistor is disposed.

14. The vacuum pump according to claim 10, wherein a predetermined gap for thermal insulation is provided between the outlet port-side casing portion and the control board portion casing.

15. The vacuum pump according to claim 10, further comprising an outer covering body for covering at least a part of a section of the outlet port-side casing portion in which the hollow portion housing the regenerative resistor is disposed.

16. A control apparatus for controlling operations performed in a vacuum pump main body, the control apparatus comprising:

a regenerative resistor configured to treat regenerative energy generated by controlling the operations performed in the vacuum pump main body; and a control board portion equipped with a control circuit for controlling the operations performed in the vacuum pump main body, wherein the control board portion is disposed inside a control board portion casing, which encloses the control board portion, and wherein the regenerative resistor is inserted into a hollow portion of a housing of the vacuum pump main body through an opening portion on an outer peripheral surface of the housing and connected to the control board portion by a wire, wherein the housing defines an inlet port and an outlet port.

17. The control apparatus according to claim 16, wherein the control board portion casing is disposed under an outlet port-side casing portion of the vacuum pump main body housing and integrated with the vacuum pump main body.

18. The control apparatus according to claim 17, wherein a predetermined gap for thermal insulation is provided between the outlet port-side casing portion and the control board portion casing.

* * * * *